US011278088B2

(12) United States Patent
Yamagata

(10) Patent No.: US 11,278,088 B2
(45) Date of Patent: Mar. 22, 2022

(54) PARASOL

(71) Applicant: YMEK CO., LTD., Tokyo (JP)

(72) Inventor: Yoshinosuke Yamagata, Tokyo (JP)

(73) Assignee: YMEK CO., LTD., Tokyo (JP)

( * ) Notice: Subject to any disclaimer, the term of this patent is extended or adjusted under 35 U.S.C. 154(b) by 0 days.

(21) Appl. No.: 17/252,171

(22) PCT Filed: Dec. 24, 2018

(86) PCT No.: PCT/JP2018/047405

§ 371 (c)(1),
(2) Date: Dec. 14, 2020

(87) PCT Pub. No.: WO2020/079859

PCT Pub. Date: Apr. 23, 2020

(65) Prior Publication Data

US 2021/0267328 A1 Sep. 2, 2021

(30) Foreign Application Priority Data

Oct. 19, 2018 (JP) ..... JP2018-004053 U
Dec. 4, 2018 (JP) ..... JP2018-226941

(51) Int. Cl.
*A45B 11/00* (2006.01)
*A45B 19/04* (2006.01)
(Continued)

(52) U.S. Cl.
CPC ..... *A45B 11/00* (2013.01); *A45B 19/04* (2013.01); *A45B 2011/005* (2013.01); *A45B 2019/004* (2013.01); *A45B 2023/0012* (2013.01)

(58) Field of Classification Search
CPC .... A45B 11/00; A45B 19/04; A45B 2011/005
See application file for complete search history.

(56) References Cited

U.S. PATENT DOCUMENTS 1,126,293 A * 1/1915 Ryder ..... A45B 11/00 135/20.1
3,822,850 A * 7/1974 Elias ..... E04H 17/18 248/551
(Continued)

FOREIGN PATENT DOCUMENTS

CN 101044930 A 10/2007
CN 202858069 U 4/2013
(Continued)

OTHER PUBLICATIONS

International Search Report (in Japanese and English) and Written Opinion issued in PCT/JP2018/047405, dated Apr. 2, 2019, 17 pages provided.
(Continued)

*Primary Examiner* — Noah Chandler Hawk
(74) *Attorney, Agent, or Firm* — Hamre, Schumann, Mueller & Larson, P.C.

(57) ABSTRACT

A parasol includes a tension rod-type pole that has multiple, length-adjustable telescopic portions; a lower hub that may be penetrated by the pole and that is configured to move in a vertical direction along the pole; a protruding portion that is provided on the pole and that is configured to restrict downward movement of the lower hub; an upper hub that is fixed to the pole; ribs that are joined to the upper hub and that are configured to rotate vertically but not horizontally; struts that are provided for the ribs and that connect the ribs and the lower hub; and a sheet that is provided between the ribs.

8 Claims, 5 Drawing Sheets

(51) Int. Cl.
*A45B 19/00* (2006.01)
*A45B 23/00* (2006.01)

(56) References Cited

U.S. PATENT DOCUMENTS 4,086,931 A * 5/1978 Hall ..... E04H 15/001 135/98
4,433,699 A * 2/1984 Schultes ..... A45B 25/02 135/15.1
4,836,232 A * 6/1989 De Rosa ..... A45B 11/00 135/118
5,056,753 A * 10/1991 Lunau ..... E04G 21/1808 248/542
5,564,453 A * 10/1996 Steiner ..... A45B 19/06 135/26
5,924,469 A * 7/1999 Whittemore ..... A47H 21/00 160/368.1
6,273,115 B1 8/2001 Guggisberg
6,422,252 B1 * 7/2002 Pilz ..... A45B 17/00 135/20.1
6,745,787 B1 * 6/2004 Curtis ..... E04H 15/003 135/117
8,393,343 B2 * 3/2013 VanVonderen ..... E04F 10/04 135/98

FOREIGN PATENT DOCUMENTS

DE 1207560 B 12/1965
JP S62112801 A 5/1987
JP H04117704 A 4/1992
JP H06217813 A 8/1994
JP H07232644 A 9/1995
JP 2003210225 A 7/2003
JP 2004065786 A 3/2004
JP 2004132053 A 4/2004
JP 2018050744 A 4/2018

OTHER PUBLICATIONS

Parasol, Pocket Interior, Rakuten Shop for furniture, general merchandise and pet supply, found in https://item.rakuten.co.jp/at-ptr/fj-c-10217-20000/?scid=af_pc_etc&sc2id=af_113_0_10001868.

* cited by examiner

[FIG. 1]
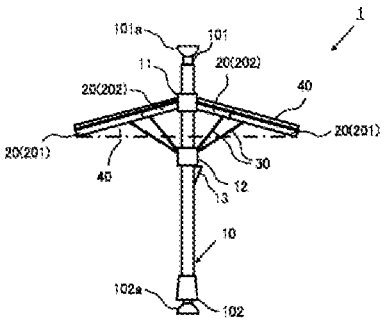
[FIG. 2]
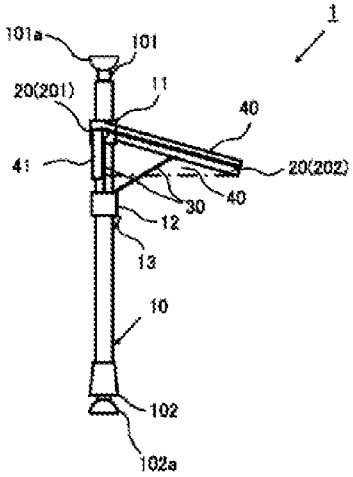
[FIG. 3]
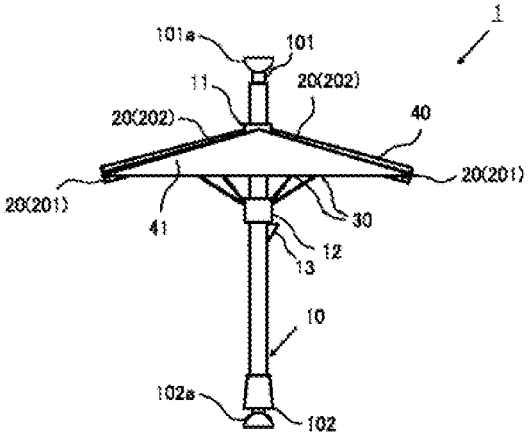

[FIG. 4]
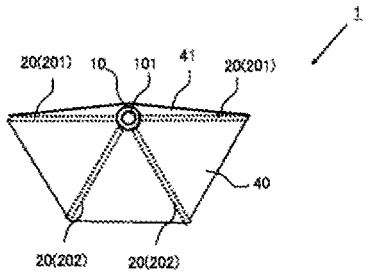
[FIG. 5]
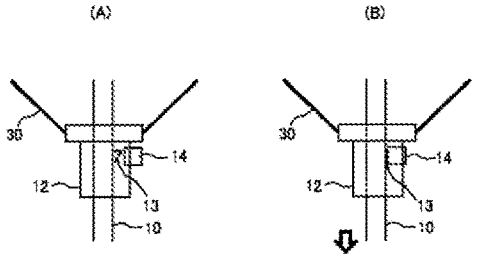
[FIG. 6]
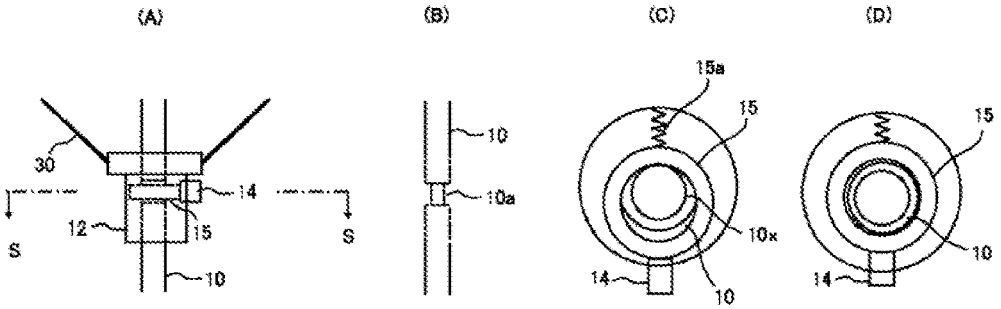
[FIG. 7]
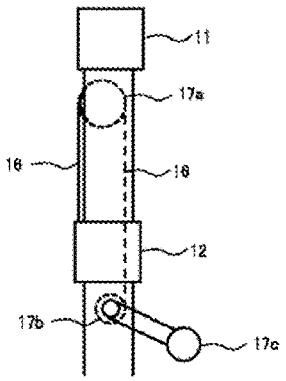

[FIG. 8]
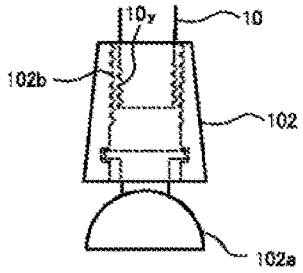
[FIG. 9]
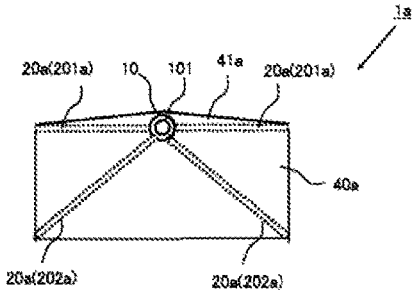
[FIG. 10]
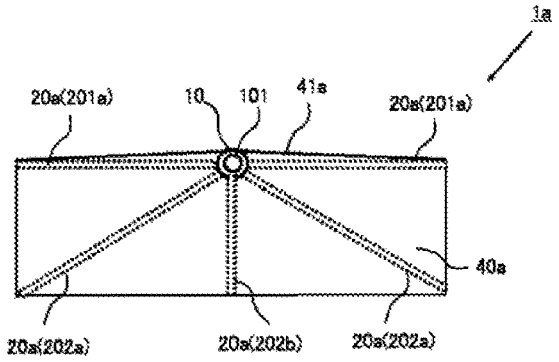
[FIG. 11]
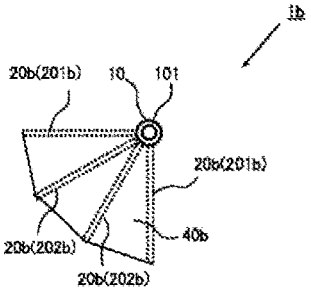

[FIG. 12]
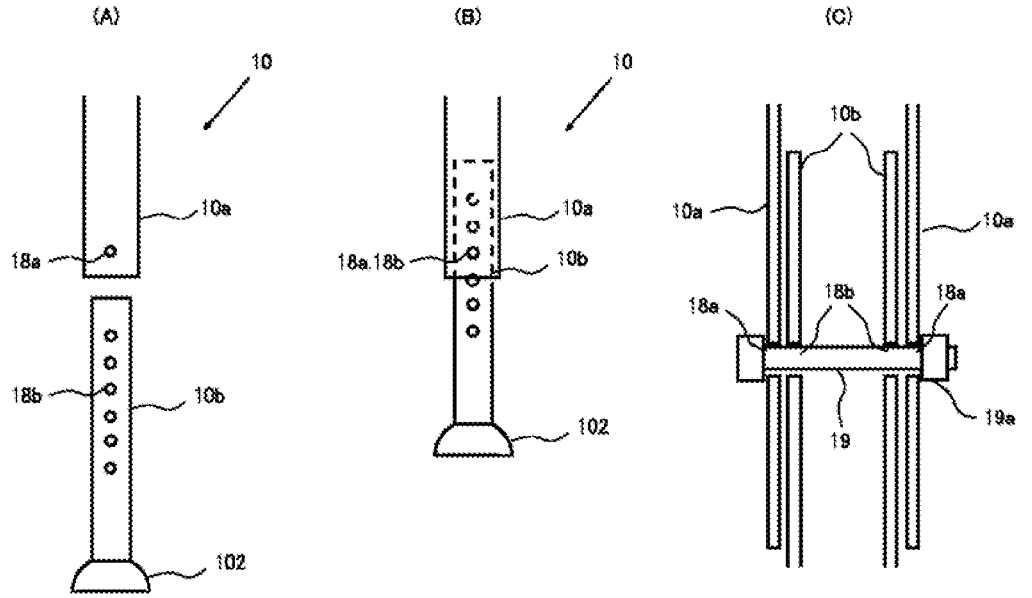
[FIG. 13]
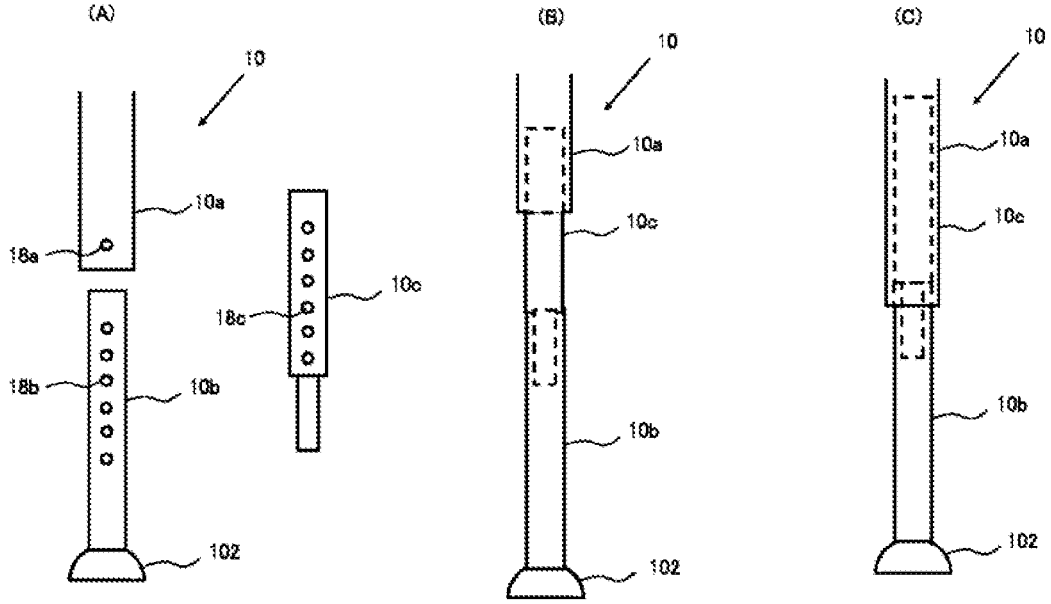

[FIG. 14]
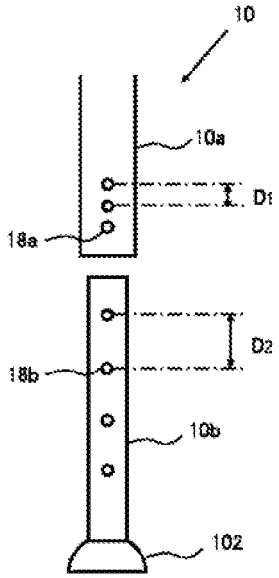

PARASOL

TECHNICAL FIELD

The present invention relates to a parasol that can be installed at eaves of a building or the like.

BACKGROUND ART

A parasol that is installed at eaves of a house or a store and used as a sunshade or a rain shield is known (refer to, for example, Non-Patent Literature 1).

However, such a parasol uses a base (a member that grips a lower end of a pole) to hold a pole in an upright position. An installation location is limited by volume and weight of the base, and labor required for installation is large.

CITATION LIST

Non-Patent Literature

Non-Patent Literature 1: "Space-saving Semi-circular Parasol that can be Used near Wall"
https://item.rakuten.co.jp/at-ptr/fj-c-10217-20000/?scid=af_pc_etc&sc2id=af_113_0_10001868

SUMMARY OF INVENTION

Technical Problem

An object of the invention is to provide a parasol that can be easily installed in various places and used as a sunshade or a rain shield.

Solution to Problem

A parasol of the invention includes:

only one tension rod-type pole including a telescopic portion and having an adjustable length;

a lower hub penetrated by the pole and configured to move in a vertical direction along the pole;

a locking member provided on the pole or the lower hub and configured to restrict downward movement of the lower hub;

an upper hub fixed to the pole;

three or more ribs joined to the upper hub and configured to rotate vertically and to not rotate horizontally;

struts respectively provided for the ribs and connecting the ribs and the lower hub; and a sheet provided between the ribs.

Regarding an arrangement of the ribs in a top view, two of the ribs are end ribs provided at an angle of approximately 180 degrees;

middle ribs, which are the ribs excluding the end ribs, exist only on one side of a straight line formed by the two end ribs; and the sheet exists only on the one side.

According to this feature, the parasol can be installed without using a base, so that installation of the parasol at eaves of a building or the like only requires to install the only one pole between a ceiling surface and a floor surface, and the parasol can be installed easily without any labor. The parasol can be installed like a pent-roof by aligning the end ribs provided at the angle of approximately 180 degrees along a surface of the building.

A parasol of the invention includes:

only one tension rod-type pole including a telescopic portion and having an adjustable length;

a lower hub penetrated by the pole and configured to move in a vertical direction along the pole;

a locking member provided on the pole or the lower hub and configured to restrict downward movement of the lower hub;

an upper hub fixed to the pole;

ribs joined to the upper hub and configured to rotate vertically and to not rotate horizontally;

struts respectively provided for the ribs and connecting the ribs and the lower hub; and a sheet provided between the ribs.

Regarding an arrangement of the ribs in the top view, two of the ribs are end ribs provided at an angle of approximately 90 degrees;

middle ribs, which are the ribs excluding the end ribs, exist only within an angle of approximately 90 degrees between the two end ribs; and the sheet exists only within the angle of approximately 90 degrees between the two end ribs.

According to this feature, the parasol can be installed easily without any labor by installing the only one pole between the ceiling surface and the floor surface. The parasol can be installed like a pent-roof at a corner of the building by aligning the end ribs provided at the angle of approximately 90 degrees along the corner of the building.

The parasol of the invention includes two or more of the middle ribs, and in a state where the lower hub is locked by the protruding portion, four points, which are tips of the two end ribs and two of the middle ribs, are arranged at four vertices of a rectangle in the top view.

According to this feature, the parasol can be provided with a rectangular sheet, similar to an awning tent.

In the parasol of the invention, the telescopic portion is provided on a lower side of the pole.

According to this feature, an upper side of the pole can be fixed to the ceiling surface and a length can be adjusted by the lower telescopic portion, and the pole can be easily installed between the ceiling surface and the floor surface.

In the parasol of the invention, the middle ribs are arranged at an equal angle sequentially from one of the end ribs to the other one of the end ribs, and all the ribs have an equal length.

According to this feature, a shape of the sheet of the parasol can be a fan shape (including a semicircular shape) in the top view.

In the parasol of the invention, the pole includes a length adjustment portion in which an outer pipe and an inner pipe inserted into the outer pipe are locked by a bar that penetrates hole portions respectively provided on the outer pipe and the inner pipe; at least one of the outer pipe and the inner pipe is provided with two or more of the hole portions at different vertical positions; and the length of the pole is adjusted by selecting the hole portions into which the bar is inserted.

According to this feature, a telescopic degree of the pole is increased, so that the parasol can cope with a wide range of eave heights.

In the parasol of the invention, the inner pipe includes two or more partial inner pipes configured to be connected and separated from each other, and each of the partial inner pipes has a uniform thickness and is provided with the hole portions.

According to this feature, since the number of the partial inner pipes used can be changed, the telescopic degree of the pole is further increased, and the parasol can cope with a further wide range of the eave heights.

In the parasol of the invention, both the outer pipe and the inner pipe have two or more of the hole portions;

one of the outer pipe and the inner pipe is provided with n of the hole portions at an equal interval, which is a first interval equal to or less than a telescopic length of the telescopic portion, in the vertical direction; and the other one of the outer pipe and the inner pipe is provided with the hole portions at an equal interval, which is a second interval n times the first interval, in the vertical direction.

According to this feature, a length of the inner pipe inserted into the outer pipe can be adjusted in steps of the first interval. A length shorter than the first interval can be adjusted by the telescopic portion. That is, the length of the pole can be strictly adjusted for any eave height.

Advantageous Effect of Invention

According to the parasol of the invention, the parasol can be installed without using a base, so that installation of the parasol at eaves of a building or the like only requires to install only one pole between a ceiling surface and a floor surface, and the parasol can be installed easily without any labor.

BRIEF DESCRIPTION OF DRAWINGS

FIG. 1 is a front view of a parasol. (Embodiment 1)

FIG. 2 is a side view of the parasol. (Embodiment 1)

FIG. 3 is a rear view of the parasol. (Embodiment 1)

FIG. 4 is a top view of the parasol. (Embodiment 1)

FIGS. 5(A) and 5(B) are enlarged views illustrating a lower hub and a protruding portion. (Embodiment 1)

FIGS. 6(A) to 6(D) are enlarged views illustrating another structure of the lower hub. (Embodiment 1)

FIG. 7 is a view illustrating another structure for moving the lower hub. (Embodiment 1)

FIG. 8 is a view showing a telescopic portion. (Embodiment 1)

FIG. 9 is a top view of a parasol. (Embodiment 2)

FIG. 10 is a top view of the parasol. (Embodiment 2)

FIG. 11 is a top view of a parasol. (Embodiment 3)

FIGS. 12(A) to 12(C) are views showing a structure of a pole. (Embodiment 4)

FIGS. 13(A) to 13(C) are views showing a structure of the pole. (Embodiment 4)

FIG. 14 is a view showing an arrangement of hole portions. (Embodiment 4)

DESCRIPTION OF EMBODIMENTS

Hereinafter, embodiments of the invention will be described with reference to the drawings.

Embodiment 1

FIG. 1 is a front view of a parasol 1 of the embodiment; FIG. 2 is a side view; FIG. 3 is a rear view; and FIG. 4 is a top view. As shown in FIGS. 1 and 2, the parasol 1 is provided with one pole 10 extending in a vertical direction. The pole 10 is a cylindrical pillar having a hollow inside, and is made of, for example, iron or aluminum. A ring-shaped upper hub 11 is fixed to the pole 10 in a penetrating manner near an upper part of the pole 10. Below the upper hub 11, a ring-shaped lower hub 12 is provided on the pole 10 in a penetrating manner so as to be movable in the vertical direction along a longitudinal direction of the pole 10. The upper hub 11 and the lower hub 12 are made of, for example, a synthetic resin.

The upper hub 11 is joined to ends of four ribs 20 having an equal length. Each rib 20 is provided so as to be rotatable in the vertical direction and non-rotatable in a horizontal direction. The number of the ribs 20 may be designed as any number as long as the number is 3 or more.

The lower hub 12 and an intermediate portion of each rib 20 are connected with each other by one strut 30. When the lower hub 12 is moved along the pole 10, the rib 20 and the strut 30 rotate in the vertical direction in conjunction with the movement. The rib 20 and the strut 30 are made of, for example, stainless steel, aluminum, plated iron, or the like.

The pole 10 is provided with a protruding portion 13 that restricts a downward movement of the lower hub 12. FIGS. 1 and 2 show a state in which the lower hub 12 is locked by the protruding portion 13 located below the lower hub 12 to restrict the downward movement. The protruding portion 13 serves as a locking member that restricts the downward movement of the lower hub 12. The protruding portion 13 has a slope has an upper end portion protruding in the horizontal direction and is inclined toward the pole 10 from the protruding upper end portion toward a lower end portion.

A slit (not shown) extending in the vertical direction is formed on an outer peripheral surface of the pole 10, and the protruding portion 13 is urged to protrude from the inside of the pole 10 to an outside through the slit by an elastic mechanism (not shown) provided in the pole 10.

In the state shown in FIGS. 1 and 2 where the lower hub 12 is locked by the protruding portion 13, when a force is applied to the protruding portion 13 from the outside toward the pole 10, the protruding portion 13 enters the inside of the pole 10. Therefore, locking between the lower hub 12 and the protruding portion 13 is released, and the lower hub 12 can be moved below the protruding portion 13. When storing or transporting the parasol 1, the lower hub 12 can be moved below the protruding portion 13, and the rib 20 and the strut 30 can be arranged close to the pole 10, so that the parasol 1 is prevented from being bulky.

In a case where the lower hub 12 is below the protruding portion 13, and the lower hub 12 is moved upward, when the lower hub 12 reaches a position of the protruding portion 13, the protruding portion 13 is pressed by a cylinder inner wall of the lower hub 12 and enters the inside of the pole 10. Therefore, the lower hub 12 can be moved above the position of the protruding portion 13. When the lower hub 12 is moved above the protruding portion 13, the protruding portion 13 protrudes from the inside of the pole 10 to the outside, so that the lower hub 12 is locked by the protruding portion 13, and each rib 20 is arranged at a fixed position.

Here, a relation between the lower hub 12 and the protruding portion 13 is not limited to that shown in the drawings. FIGS. 5(A) and 5(B) are enlarged views illustrating the lower hub and the protruding portion. The parasol 1 is larger than a normal umbrella, and the lower hub 12 is also larger. Therefore, as shown in FIG. 5A, the protruding portion 13 locks the lower hub 12 inside the lower hub 12 instead of at a lower end of the lower hub 12.

In this case, a push button 14 used for pushing the protruding portion 13 into the pole 10 is provided on the lower hub 12. As shown in FIG. 5(B), the push button 14 is pushed to push the protruding portion 13 into the pole 10, so that the lower hub 12 is moved.

FIGS. 6(A) to 6(D) are enlarged views illustrating another structure of the lower hub. As shown in FIG. 6A, a disk portion 15 is provided in the lower hub 12. The disk portion 15 has a hole portion in a center thereof, through which the pole 10 can be penetrated.

As shown in FIG. 6(B), the pole 10 is provided with a small diameter portion 10*x*. FIG. 6(C) is a sectional view taken along a line S-S of FIG. 6(A) in a state where the lower hub 12 is locked. The disk portion 15 is urged downward in the drawing by a spring 15*a*. Therefore, the disk portion 15 enters the small diameter portion 10*x* and functions as a locking member that restricts a downward movement of the lower hub 12.

By pressing the push button 14, as shown in FIG. 6(D), the disk portion 15 can be moved, and then the pole 10 penetrates through the hole portion, and locking between the lower hub 12 and the disk portion 15 is released, so that the lower hub 12 can be moved downward.

FIG. 7 is a view illustrating another structure to move the lower hub. A wire 16 is connected to the lower hub 12, and the lower hub 12 is moved upward by pulling the wire 16 upward. If the wire 16 is set to a free length without being pulled upward, the lower hub 12 moves downward due to the weight of itself.

The wire 16 goes around a pulley 17*a* and is wound around a reel 17*b*. The reel 17*b* can be rotated by operating a handle 17*c* provided outside the pole 10. By operating the handle 17*c* so as to wind the wire 16 around the reel 17*b*, the lower hub 12 can be moved upward. By unwinding the wire 16 from the reel 17*b*, the lower hub 12 can be moved downward.

When the lower hub 12 is moved upward and the lower hub 12 is locked with the parasol opened, the wire 16 functions as a locking member that restricts the downward movement of the lower hub 12.

In order to prevent the lower hub 12 from being moved excessively upward, a stopper (a protrusion that locks the lower hub) may be provided on the pole 10.

The ribs 20 include two end ribs 201 provided at an angle of approximately 180 degrees in the top view and two middle ribs 202 other than the end ribs 201. As shown in FIG. 3, the two end ribs 201 form a straight line, and the two middle ribs 202 exist only on one side of the straight line formed by the two end ribs 201. The middle ribs 202 are sequentially arranged at an equal angle (here, 60 degrees) from one end rib 201 toward the other end rib 201. The number of the middle ribs 202 is not limited to two, and may be three or more, or only one.

A sheet 40 is provided between the ribs 20. As shown in FIG. 3, the sheet 40 exists on one side of the straight line formed by the two end ribs 201. In the embodiment, the one sheet 40 covers the end ribs 201 and the middle ribs 202 as a whole. During coverage, alignment is performed such that the two end ribs 201 are located at portions corresponding to a diameter of the sheet 40, and ends of the middle ribs 202 are located at portions corresponding to a circumference of the sheet 40. As a material of the sheet 40, various tent fabrics can be adopted. The sheet 40 may be subjected to an ultraviolet ray blocking treatment, a waterproof coating on a back surface, a water repellent treatment, and the like.

Here, since the sheet 40 is provided so as to be inclined, the ribs 20 (the end ribs 201 and the middle ribs 202) are on an opposite side of the sheet 40. The drawings are drawn assuming that the sheet 40 is transparent and the ribs 20 (the end ribs 201 and the middle ribs 202) are visible. A lower edge of the sheet 40 is indicated by a dashed line. Of course, the sheet 40 may not be transparent and the ribs 20 (the end ribs 201 and the middle ribs 202) may not be visible.

The sheet 40 is not limited to one sheet, and three fan-shaped sheets having a central angle of 60 degrees may be used. In this case, edge portions corresponding to diameters of the fan-shaped sheets are connected to the ribs 20 along longitudinal directions.

A sheet 41 may be provided between the two end ribs 201 (see FIG. 2). As shown in FIG. 3 (unlike FIGS. 1 and 2, the sheet 41 is drawn opaquely), the sheet 41 covers a back side, and together with the sheet 40, goes around a periphery of the parasol 1 once.

Telescopic portions 101 and 102 are provided on an upper side and a lower side of the pole 10, respectively. When installing the pole 10 in a form of a tension rod under eaves of a building or the like, by expanding and contracting the telescopic portions 101 and 102, a length of the pole 10 can be adjusted so as to be equal to a distance between a ceiling surface and a floor surface.

Publicly known telescopic structures can be used as a telescopic structure of the telescopic portions 101 and 102. For example, a structure shown in FIG. 8 can be used. The drawing shows the telescopic portion 102 on the lower side, but the same may be applied to the telescopic portion 101 on the upper side. A female screw 102*b* provided on the telescopic portion 102 and a male screw 10*y* provided on the pole 10 are screwed together, and by rotating the telescopic portion 102, a protruding length of the telescopic portion 102 from the pole 10 (a height of the parasol 1) is adjusted.

Hemispherical pads 101*a* and 102*a* are provided at tips of the telescopic portions 101 and 102. The pad 102*a* can freely rotate with respect to (a main body of) the telescopic portion 102 without a screw. According to this structure, the height of the parasol 1 can be adjusted by rotating the telescopic portion 102 while keeping the pad 102*a* in contact with and fixed to a ground. The pad 102*a* does not have to be hemispherical as long as a lower surface thereof is flat, and may be a disk shape or other shapes.

The telescopic portion 101 on the upper side is provided above the sheet 40 and the upper hub 11. Therefore, when installing the parasol 1 at the eaves, first, a length of the pole 10 above the sheet 40 (that is, a portion between the sheet 40 and the ceiling surface of the eaves) is adjusted to a desired length by using the telescopic portion 101 on the upper side, and then the length of the pole 10 is adjusted to be equal to the distance between the ceiling surface and the floor surface of the eaves of the building by using the telescopic portion 102 on the lower side.

Here, it is not necessarily to provide both the telescopic portions 101 and 102. For example, the telescopic portion 102 on the lower side may be provided alone, while providing only the pad 101*a* on the upper side. It is sufficient to keep a substantially constant length above the sheet 40, and to adjust the length of the pole 10 using only the telescopic portion 102 on the lower side.

Here, when only the pad 101*a* is used on the upper side, the pad 101*a* may be the same member as the pad 102*a* from a viewpoint of ease of production. Then, both the pad 101*a* and the pad 102*a* can rotate. In consideration of a danger that the pole 10 (and the parasol 1) may rotate, it is preferable to fix the pad 101*a* to the pole 10 by screwing or the like to stop the rotation of the pole 10.

A procedure for installing such the parasol 1 under the eaves of the building will be described. In the parasol 1 before installation, the lower hub 12 is located below the protruding portion 13, and the ribs 20 and the struts 30 are arranged close to the pole 10.

First, depending on a purpose of use or preference, the distance between the ceiling surface and the sheet 40 is determined considering whether the sheet 40 should be close to the ceiling surface under the eaves, or whether the sheet 40 should be sufficiently spaced from the ceiling surface. The length of the telescopic portion 101 on the upper side of the pole 10 is adjusted according to the determined distance between the ceiling surface and the sheet 40. However, the distance between the ceiling surface and the sheet 40 may be fixed, and the telescopic portion 101 on the upper side may not be provided.

Next, the length of the telescopic portion 102 on the lower side of the pole 10 is adjusted according to the distance between the ceiling surface and the floor surface under the eaves, and the pole 10 is installed between the ceiling surface and the floor surface in a tension rod state.

Next, the lower hub 12 is slid upward along the pole 10 above the protruding portion 13, and then the sheet 40 is opened with each rib 20 being horizontal, and the lower hub 12 is locked by the protruding portion 13. Thereby, the installation of the parasol 1 is completed.

In this way, installation of the parasol 1 on the eaves of the building or the like only requires adjusting the length of the pole 10 using the telescopic portions 101 and 102 (or the telescopic portion 102 only), installing the pole 10 between the ceiling surface and the floor surface, and then moving the lower hub 12 upward to lock the lower hub 12 to the protruding portion 13. Therefore, the parasol 1 can be easily installed without any labor.

Embodiment 2

Next, Embodiment 2 will be described. The configuration described in Embodiment 1 is used as it is. Differences from Embodiment 1 will be mainly described, and detailed description of common parts will be omitted. FIG. 9 is a top view of a parasol 1*a* according to the embodiment.

Ribs 20*a* of the parasol 1*a* according to the embodiment include the two end ribs 201 and two middle ribs 202*a*. When the lower hub 12 is placed on top and the parasol is opened, as shown in FIG. 9, four points that are tips of the two end ribs 201 and the two middle ribs 202*a* are arranged at four vertices of a rectangle in the top view. All the end ribs 201 and the middle ribs 202*a* are covered with a rectangular sheet 40*a* having four vertices, which are the tips of the two end ribs 201 and the two middle ribs 202*a*.

In this way, despite that the parasol 1*a* has only the one pole 10, a shape of the sheet 40*a* can be a wide rectangular shape by configuring the four points, which are the tips of the two end ribs 201 and the two middle ribs 202*a*, to be arranged at the four vertices of the rectangle in the top view.

Here, since the sheet 40*a* is provided so as to be inclined, the ribs 20*a* (the end ribs 201 and the middle ribs 202) are on an opposite side of the sheet 40*a*. The drawing is drawn assuming that the sheet 40*a* is transparent and the ribs 20*a* (the end ribs 201 and the middle ribs 202) are visible. A lower edge of the sheet 40*a* is indicated by a dashed line. Of course, the sheet 40*a* may not be transparent and the ribs 20*a* (the end ribs 201 and the middle ribs 202) may not be visible.

In order to prevent the sheet 40*a* from loosening, for example, when the parasol 1 is long in a lateral direction as shown in FIG. 10, in a state where the lower hub 12 locked by the protruding portion 13, one middle rib 202*b* extending horizontally and perpendicular to the end ribs 201 may be provided. In this case, one additional strut 30 used for connecting the middle rib 202*b* and the lower hub 12 has to be provided.

Embodiment 3

Next, Embodiment 3 will be described. The configuration described in Embodiments 1 and 2 is used as it is. Differences from Embodiments 1 and 2 will be mainly described, and detailed description of common parts will be omitted. FIG. 11 is a top view of a parasol 1*b* according to the embodiment.

Ribs 20*b* of the parasol 1*b* according to the embodiment include two end ribs 201*b* and two middle ribs 202*b*. The two end ribs 201*b* are arranged at an angle of 90 degrees. When the lower hub 12 is placed on top and the parasol is opened, the parasol has a quarter circle shape in the top view as shown in FIG. 11.

In this way, the parasol 1*b* can be installed at a corner of a building by being a quarter circle shape in the top view.

Embodiment 4

Next, Embodiment 4 will be described. Embodiment 4 is for adjusting the length of the pole, and can be applied to any of the parasols described in Embodiments 1, 2, and 3. Parts other than the pole 10 have the same configurations as in Embodiments 1, 2, and 3. Description will be centered on the pole 10, and detailed description of the other parts will be omitted.

FIGS. 12(A) to 12(C) are views showing a structure of the pole. The pole 10 can be expanded and contracted so that the length can be adjusted larger (for example, 30 cm) (however, the length may not be adjusted). As shown in FIG. 12(A), the pole 10 includes an outer pipe 10*a* and an inner pipe 10*b*, and a hole portion 18*a* is provided in the outer pipe 10*a* and hole portions 18*b* are provided in the inner pipe 10*b*.

The inner pipe 10*b* is inserted into the outer pipe 10*a*, and a length of the inner pipe 10*b* extending from the outer pipe 10*a* is adjusted (see FIG. 12(B)).

One of the plurality of hole portions 18*b* is fixed by being fitted with the hole portion 18*a*. The length is adjusted depending on which of the plurality of hole portions 18*b* is fitted with the hole portion 18*a*. A plurality of hole portions 18*a* may be provided and the number of the hole portion 18*b* may be one.

The hole portion 18*b* to be fitted with the hole portion 18*a* is determined, and as shown in FIG. 12(C) (a sectional view showing the hole portions), a bar 19 is inserted into the hole portion 18*a* and the hole portion 18*b* to fix the length (a vertical position of the hole portion 18*b*). For example, the bar 19 may be a bolt and may be stabilized by a nut 19*a*.

In this case, the protruding portion 13 or the handle 17*c* is provided on the outer pipe 10*a*. The position of the lower hub 12 (the position of the protruding portion 13) when used as a parasol is fixed, and it is difficult to provide the protruding portion 13 or the handle 17*c* on the movable inner pipe 10*b*.

Here, the lower hub 12 moves around a periphery of the upper side of the pole 10. Since the inner pipe 10*b* is inserted into the outer pipe 10*a* when the pole 10 is expanded and contracted, it is preferable that the upper side of the pole 10 is the outer pipe 10*a*.

FIGS. 13(A) to 13(C) are views showing a structure of the pole, which is different from the structure in FIG. 12. As shown in FIG. 13(A), a partial inner pipe 10*c* is provided. The inner pipe 10*b* in FIG. 12(A) includes the two partial inner pipes 10*b* and 10*c*.

A lower end of the partial inner pipe 10*c* has a reduced diameter and can be inserted into the partial inner pipe 10*b*. Upper sides of the partial inner pipe 10*b* and the partial inner pipe 10*c* have the same diameter, and respectively have the hole portions 18*b* and hole portions 18*c*. That is, the partial inner pipe 10*b* can be used as an inner pipe alone (similar to FIG. 12), and the partial inner pipe 10*c* can be inserted into the partial inner pipe 10*b*, so that the partial inner pipe 10*b* and the partial inner pipe 10*c* can be used together as an inner pipe. FIG. 13(B) shows a state in which the partial inner pipe 10*b* and the partial inner pipe 10*c* are used together as an inner pipe.

Significance of the partial inner pipe 10*c* will be described. During use as shown in FIG. 12, a depth that can be inserted into the outer pipe 10*a* of the inner pipe 10*b* (that is, an adjustable amount of the length of the pole 10) is restricted by the reel 17*b* and the like. Here, in a case where the partial inner pipe 10*b* and the partial inner pipe 10*c* are used together as an inner pipe, when the inner pipe needs to be inserted deeply, the partial inner pipe 10*c* can be removed to use only the partial inner pipe 10*b* as an inner pipe, which is the same as inserting further by the length of the partial inner pipe 10*c*. That is, the adjustable amount of the length of the portion 10 can be increased.

The partial inner pipe 10*c* is inserted into the outer pipe 10*a* as shown in FIG. 13(C). Here, it is possible but not preferable to remove the partial inner pipe 10*c* and use only the partial inner pipe 10*b* as an inner pipe in a state where only a minute portion at a tip of the partial inner pipe 10*b* is inserted as shown in FIG. 13(C). This is because an insertion depth of the partial inner pipe 10*b* is small, so that fixing with the outer pipe 10*a* is insufficient. It is preferable to remove the partial inner pipe 10*c* when the insertion depth of the partial inner pipe 10*b* is sufficiently large.

Therefore, it is necessary to devise connection between the partial inner pipe 10*b* and the partial inner pipe 10*c*. Although it is possible to connect using the bar 19 as shown in FIG. 12(C), the bar 19 (including the nut 19*a*) protrudes to an outside of the partial inner pipe 10*b* at a connecting portion. Due to this protruding portion, the partial inner pipe 10*b* cannot be inserted into the outer pipe 10*a*. Therefore, the connection should be a method without a member protruding outward, for example, a method in which an expansion spring member extending from the partial inner pipe 10*c* is locked to the partial inner pipe 10*b*. If the partial inner pipe 10*c* is deeply inserted into the partial inner pipe 10*b* and the connecting portion is sufficiently lowered, it is also possible to connect using the bar 19.

The partial inner pipe 10*c* is not limited to one, and two or more may be used. The adjustable amount of the length of the pole 10 can be further increased.

FIG. 14 is a view showing an arrangement of the hole portions. Three of the hole portions 18*a*, which is one in FIGS. 12 and 13, are provided. Here, a distance $D_2$ between each two of the hole portions 18*b* is three times a distance $D_1$ between each two of the hole portions 18*a*.

The length of the pole 10 can be set in $D_1$ increments by selecting the hole portion 18*a* and the hole portion 18*b* into which the bar 19 is inserted. Assuming that an insertion length when the hole portion 18*b* is fitted with the bottom hole portion 18*a* is L, insertion lengths of $L+D_1$ and $L+2D_1$ can be obtained by fitting the hole portion 18*b* with the other hole portions 18*a*. An insertion length of $L+3D_1$ can be realized by selecting another hole portion 18*b*. That is, the length of the pole 10 can be set in the $D_1$ increments. For example, assuming that $D_1$=2 cm and $D_2$=6 cm, the length of the pole 10 can be set in 2 cm increments.

In general, the number of the hole portions 18*a* is not limited to three, as long as $D_2=nD_1$, where n is the number.

Here, consider $D_1$. The pole 10 can be expanded and contracted first to adjust an approximate length in $D_1$ increments, and then the length can be finely adjusted by the telescopic portion 102. That is, if $D_1$ is smaller than the length adjustable by the telescopic portion 102, the length of the pole 10 can be any length.

INDUSTRIAL APPLICABILITY

The parasol according to the invention can be easily installed not only at eaves but also at places between a ceiling surface and a floor surface, and can be used as a sunshade or a rain shield.

REFERENCE SIGNS LIST

1, 1*a*, 1*b* parasol
10, 10*a*, 10*b*, 10*c* pole
10*x* small diameter portion
10*y* screw
101 telescopic portion
101*a* pad
102 telescopic portion
102*a* pad
102*b* screw
11 upper hub
12 lower hub
13 protruding portion (locking member)
14 push button
15 disk portion (locking member)
15*a* spring
16 wire (locking member)
17*a* pulley
17*b* reel
17*c* handle
18*a*, 18*b* hole portion
19 bar (bolt)
19*a* nut
20 rib
201, 201*a*, 201*b* end rib
202, 202*a*, 202*b* middle rib
30 strut
40, 40*a*, 40*b* sheet
41, 41*a* sheet

The invention claimed is:

1. A parasol, comprising:

only one tension rod-type pole including a telescopic portion and having an adjustable length;

a lower hub penetrated by the pole and configured to move in a vertical direction along the pole;

a locking member provided on the pole or the lower hub and configured to restrict downward movement of the lower hub;

an upper hub fixed to the pole;

three or more ribs joined to the upper hub and configured to rotate vertically and to not rotate horizontally;

struts respectively provided for the ribs and connecting the ribs and the lower hub;

a sheet provided between the ribs, wherein regarding an arrangement of the ribs in a top view, two of the ribs are end ribs provided at an angle of approximately 180 degrees, middle ribs, which are the ribs excluding the end ribs, exist only on one side of a straight line formed by the two end ribs, and the sheet exists only on the one side;

a pad non-rotatably fixed to an upper end of the pole;

wherein the telescopic portion is provided below the lower hub of the pole, the telescopic portion is expanded and contracted by rotation of the telescopic portion, and wherein the upper hub is configured to be non rotatable with respect to the fixed pad.

2. The parasol according to claim 1, wherein the parasol comprises two or more of the middle ribs, and in a state where the lower hub is locked to the locking member, four points, which are tips of the two end ribs and two of the middle ribs, are arranged at four vertices of a rectangle in the top view.

3. The parasol according to claim 1, wherein the telescopic portion is provided on a lower side of the pole.

4. The parasol according to claim 1, wherein the middle ribs are arranged at an equal angle sequentially from one of the end ribs to the other one of the end ribs, and all the ribs have an equal length.

5. The parasol according to claim 1, wherein the pad non-rotatably fixed to an upper end of the pole is a same type of member as the pad rotatably provided at the lower end of the pole.

6. A parasol, comprising:

only one tension rod-type pole including a telescopic portion and having an adjustable length;

a lower hub penetrated by the pole and configured to move in a vertical direction along the pole;

a locking member provided on the pole or the lower hub and configured to restrict downward movement of the lower hub;

an upper hub fixed to the pole;

ribs joined to the upper hub and configured to rotate vertically and to not rotate horizontally;

struts respectively provided for the ribs and connecting the ribs and the lower hub; and a sheet provided between the ribs, wherein regarding an arrangement of the ribs in a top view, two of the ribs are end ribs provided at an angle of approximately 90 degrees, middle ribs, which are the ribs excluding the end ribs, exist only within an angle of approximately 90 degrees between the two end ribs, and the sheet exists only within the angle of approximately 90 degrees between the two end ribs;

a pad non-rotatably fixed to an upper end of the pole;

wherein the telescopic portion is provided below the lower hub of the pole, the telescopic portion is expanded and contracted by rotation of the telescopic portion, and the upper hub is configured to be non-rotatable with respect to the fixed pad.

7. A parasol, comprising:

only one tension rod-type pole including a telescopic portion and having an adjustable length, the pole comprising:

a length adjustment portion in which an outer pipe and an inner pipe inserted into the outer pipe are locked by a bar that penetrates hole portions respectively provided on the outer pipe and the inner pipe, and at least one of the outer pipe and the inner pipe is provided with two or more of the hole portions at different vertical positions, wherein the length of the pole is adjusted by selecting the hole portions into which the bar is inserted, the inner pipe includes two or more partial inner pipes configured to be connected and separated from each other, and each of the partial inner pipes has a uniform thickness and is provided with the hole portions;

a lower hub penetrated by the pole and configured to move in a vertical direction along the pole;

a locking member provided on the pole or the lower hub and configured to restrict downward movement of the lower hub;

an upper hub fixed to the pole;

three or more ribs joined to the upper hub and configured to rotate vertically and to not rotate horizontally;

struts respectively provided for the ribs and connecting the ribs and the lower hub;

a sheet provided between the ribs, wherein regarding an arrangement of the ribs in a top view, two of the ribs are end ribs provided at an angle of approximately 180 degrees, middle ribs, which are the ribs excluding the end ribs, exist only on one side of a straight line formed by the two end ribs, and the sheet exists only on the one side.

8. A parasol, comprising:

only one tension rod-type pole including a telescopic portion and having an adjustable length, the pole comprising:

a length adjustment portion in which an outer pipe and an inner pine inserted into the outer pipe are locked by a bar that penetrates hole portions respectively provided on the outer pipe and the inner pipe, and at least one of the outer pipe and the inner pipe is provided with two or more of the hole portions at different vertical positions, wherein the length of the pole is adjusted by selecting the hole portions into which the bar is inserted, both the outer pipe and the inner pipe have two or more of the hole portions, one of the outer pipe and the inner pipe is provided with n of the hole portions at an equal interval, which is a first interval equal to or less than a telescopic length of the telescopic portion, in the vertical direction; and the other one of the outer pipe and the inner pipe is provided with the hole portions at an equal interval, which is a second interval n times the first interval, in the vertical direction;

a lower hub penetrated by the pole and configured to move in a vertical direction along the pole;

a locking member provided on the pole or the lower hub and configured to restrict downward movement of the lower hub;

an upper hub fixed to the pole;

three or more ribs joined to the upper hub and configured to rotate vertically and to not rotate horizontally;

struts respectively provided for the ribs and connecting the ribs and the lower hub;

a sheet provided between the ribs, wherein regarding an arrangement of the ribs in a top view, two of the ribs are end ribs provided at an angle of approximately 180 degrees, middle ribs, which are the ribs excluding the end ribs, exist only on one side of a straight line formed by the two end ribs, and the sheet exists only on the one side.

* * * * *